US006010078A

United States Patent [19]

Eberhardt et al.

[11] Patent Number: 6,010,078

[45] Date of Patent: Jan. 4, 2000

[54] DISTRIBUTING APPARATUS WITH TUBULAR MANIFOLD FOR AN APPLICATOR

[75] Inventors: Bernd Eberhardt, Nattheim; Martin Seliger, Steinheim, both of Germany

[73] Assignee: Voith Sulzer Papiermaschinen GmbH, Heidenheim, Del.

[21] Appl. No.: 08/904,445

[22] Filed: Jul. 31, 1997

[30] Foreign Application Priority Data

Aug. 1, 1996 [DE] Germany ..... 296 13 313 U

[51] Int. Cl.[7] ..... B65D 1/32

[52] U.S. Cl. ..... 239/63; 239/568; 239/562; 118/63; 101/DIG. 45

[58] Field of Search ..... 239/63, 455, 521, 239/562, 518, 568, 597, 576, 590, 327; 118/63, 410; 138/119; 101/DIG. 45

[56] References Cited

U.S. PATENT DOCUMENTS

| | | | |
|---|---|---|---|
| 3,630,453 | 12/1971 | Lane | 239/455 |
| 4,132,363 | 1/1979 | Kruger | 239/590.3 |
| 4,206,876 | 6/1980 | Koch | 239/455 |
| 5,401,317 | 3/1995 | Cox et al. | 239/590 |
| 5,788,162 | 8/1998 | Kurtz | 239/455 |
| 5,850,675 | 10/1998 | Madrzak | 118/410 |
| 5,858,096 | 1/1999 | Madrzak et al. | 239/455 |

FOREIGN PATENT DOCUMENTS

| | | | |
|---|---|---|---|
| 0 536 649 A1 | 10/1992 | European Pat. Off. | D21H 23/36 |
| 0 570 733 A1 | 4/1993 | European Pat. Off. | D21H 23/78 |
| 33 13 874 A1 | 10/1984 | Germany | F26B 15/18 |
| 44 32 177 A1 | 3/1996 | Germany | B05B 1/04 |
| 196 24 716 A1 | 11/1996 | Germany | B65H 18/20 |

*Primary Examiner*—Kevin Weldon
*Assistant Examiner*—Dinh Q. Nguyen
*Attorney, Agent, or Firm*—Taylor & Associates, P.C.

[57] ABSTRACT

In a distributing apparatus including a tubular manifold, for an applicator for direct or indirect application of a liquid or pasty application medium onto a traveling material web, notably a paper web or cardboard web, the cross section of the tubular manifold is variable. The adjustment of the manifold permits verying the rate of application of liquid or pastry medium across the distributors width.

19 Claims, 4 Drawing Sheets

DISTRIBUTING APPARATUS WITH TUBULAR MANIFOLD FOR AN APPLICATOR

BACKGROUND OF THE INVENTION

1. Field of the Invention

The present invention relates to a distributing apparatus with tubular manifold for an applicator for the direct or indirect application of a liquid or pasty medium onto a traveling material web, notably a paper web or cardboard web.

2. Description of the Related Art

A manifold is known, e.g., from German document No. DE 44 32 177 A1 which describes an applicator for direct or indirect application of a liquid or pasty medium. The manifold includes a slot for feeding the liquid medium into an applicator chamber. Alternatively, the manifold can include an open-jet nozzle and feed ducts through which the medium is introduced into the feed slot from a central tubular manifold.

The design of the tubular manifold is such that a maximally uniform medium dispensation to the feed slot is guaranteed across the entire machine width. An adaptation of the amount of application is effected via an adjustment mechanism on the lip of the applicator on its approach side. If such manifold is designed for a specific machine width, it is usable only with this machine width.

SUMMARY OF THE INVENTION

The objective of the present invention is to present a distributing apparatus that includes a tubular manifold and, for one, makes it possible to avoid a complete redesign of the tubular manifold for adaptation to different machine widths and, for another, offers the option of adjusting the rate of application medium fed into the feed slot and to the material web across the machine width.

The present invention uses a tubular manifold of simple design and equal dimensions, except for its length measurements, for applicators of different machine widths when the tubular manifold is variable in its cross section. Moreover, a sectional or continuous cross-sectional variation of the tubular manifold across the machine width is used to individually influence the dispensation of application medium across the machine width.

In one embodiment according to the invention, this variation of the cross section can influence also the area of passage without altering the circumference of the tubular manifold, whereby the tubular manifold itself may be constructed of a non-elastic material.

In another embodiment according to the invention, the variation of the cross section may take place during operation, enabling an adaptation of the different amounts of discharge across the machine width during the operation. Such cross-sectional variations may be effected by elastic deformation of at least parts of the tubular manifold.

In a further embodiment according to the invention, the distributing apparatus features a mechanical adjustment mechanism with a number of adjustment screws distributed across the length of the adjustment mechanism. The adjustment screws each rest directly or indirectly on a beam. The mechanical adjustment mechanism can also feature a lever assembly which, via actuators distributed across the length of the distributing apparatus, introduces forces effecting a zonewise deformation of the tubular manifold.

Yet another embodiment of the distributing apparatus includes one or several filler elements that are distributed across the machine width and which can be altered in their filling as required, causing once again an alteration of the cross section of the tubular manifold.

The distributing apparatus can also feature an actuating apparatus that includes a thermal, hydraulic, pneumatic, magnetic, magnetostrictive or piezoelectric adjustment mechanism. Similarly, actuating motors may also be provided that allow a zonewise actuation of the adjustment mechanism. The adjustment mechanism can be remotely controlled and influence the application via a closed loop, based upon measured values of the cross-sectional profile of the applied medium.

BRIEF DESCRIPTION OF TEE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
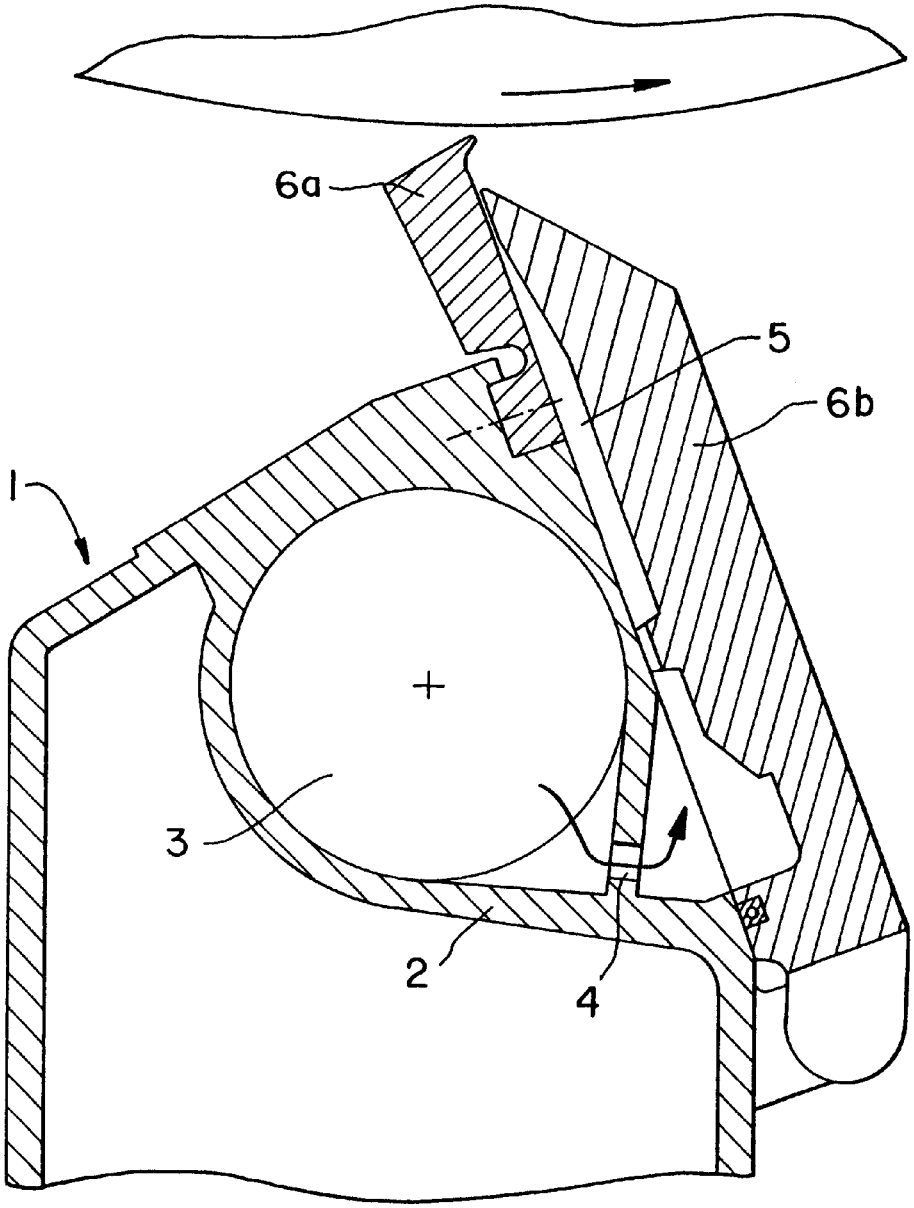
PRIOR ART Fig. 1
FIG. 1 is a side sectional view of a known applicator with a tubular manifold.

Referring now to the drawings and particularly to FIG. 1, there is shown an applicator 1 known from DE 44 32 177 with a distributing apparatus 2 for the medium being applied and a tubular manifold 3 disposed within distributing apparatus 2. Disposed between feed slot 5, formed between a first lip 6*a* and a second lip 6*b*, and tubular manifold 3 are feed ducts 4 through which the applied medium is uniformly distributed and delivered via feed slot 5, to a passing surface. The passing surface may either, in direct application, be the material web or, in indirect application, a so-called applicator roll transferring the coating medium to the material web.

Figure 2:
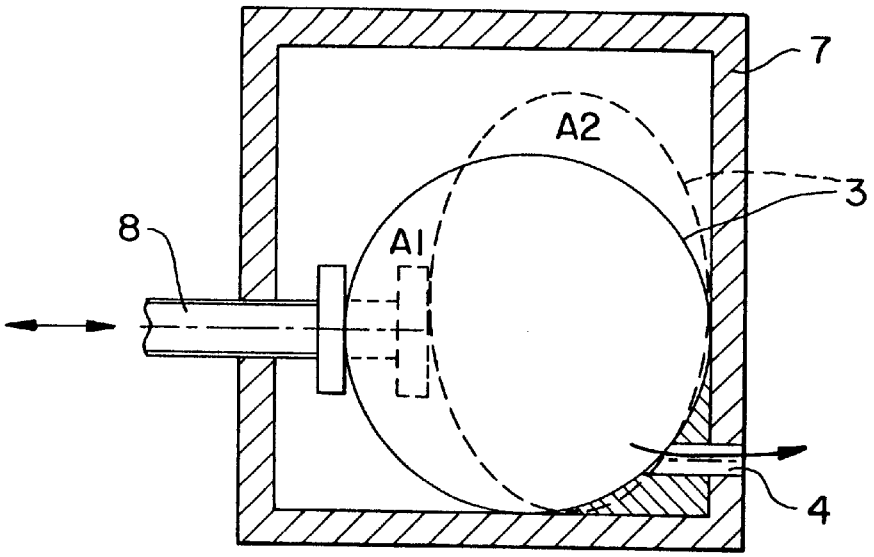
FIG. 2 is one embodiment of a distributing apparatus of the present invention with a tubular manifold of variable cross section.

FIG. 2 shows an embodiment of a distributing apparatus of the present invention including a housing 7 accommodating a flexible tubular manifold 3 which receives the coating medium via an inlet (not numbered) and, by way of outlets or feed ducts 4, dispenses the application medium maximally uniformly to the machinewide feed slot of an applicator. Illustrated schematically is an adjustment mechanism 8 which, e.g., acts via a plunger on flexible tubular manifold 3, thus causing a deformation thereof. Circular cross section A1 (solid line) achieves a maximum area of passage with a given circumference. Area of passage A2 (dashed line) illustrates the situation wherein the plunger flexes tubular manifold 3 and causes a reduction in cross-sectional area with the same circumference.

In an embodiment wherein the adjustment mechanism possesses a single plunger extending across the machine width, a uniform reduction in cross-sectional area across the machine width is obtained. In contrast, in an embodiment wherein the adjustment mechanism features a plurality of plungers, a cross-sectional alteration ranging from zonewise to continuous can be achieved across the machine width, thus influencing the feed behavior of the application medium across the machine width.

Figure 3:
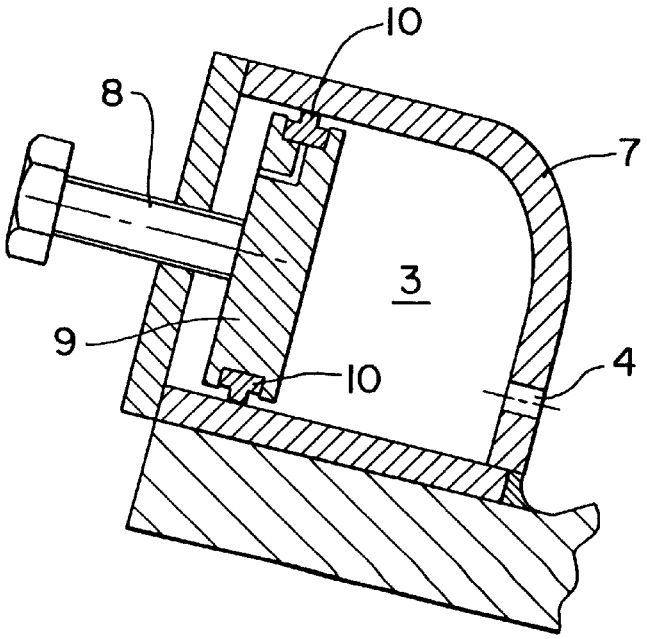
FIG. 3 is another embodiment of a distributing apparatus of the present invention with a movable wall.

FIG. 3 shows a further embodiment of a distributing apparatus according to the invention. In this case, a separate tubular manifold 3 is being forgone, tubular manifold 3 being formed instead by the interior of housing 7 with a movable wall 9 arranged sideways. Wall 9 is sealed relative to the housing by seals or packings 10 and can be moved with the aid of one or several adjustment mechanisms 8. Hereby, too, a uniformly effected cross-sectional variation of tubular manifold 3 across the entire machine width can be accomplished. Alternatively, adjustment mechanism 8 can again be configured with a plurality of plungers for individual zonewise actuation across the machine width.

Such design of tubular manifold 3 allows removal of movable wall 9 for very easy cleaning of tubular manifold 3. In addition, an optimum adaptation to different operating speeds can be realized.

In yet another embodiment (not shown), instead of movable wall 9, an elastic wall is fixedly joined to housing 7 and compressed as needed by way of plungers, thereby also affecting the cross section of tubular manifold 3.

In still another embodiment (not shown) a pressure cushion is created by a membrane traversing tubular manifold 3. This allows the generation of a uniform static pressure across the machine width, thereby achieving a uniform sizing dispensation across the entire machine width.

Figure 4:
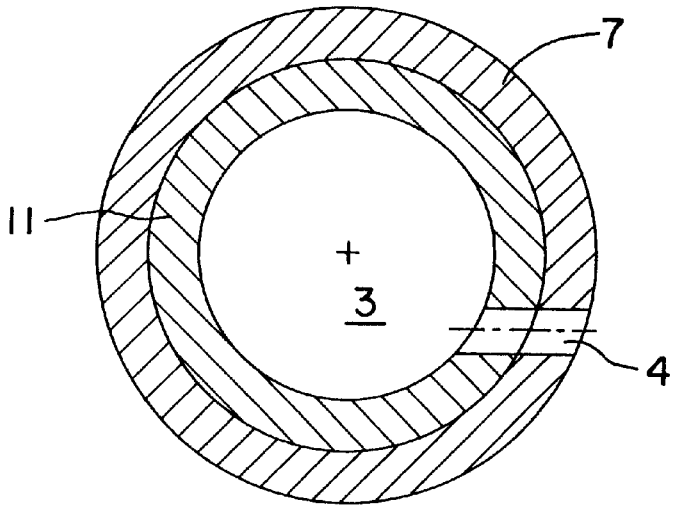
FIGS. 4 and 5 are further embodiments of a distributing apparatus of the present invention with a filler element.
Figure 5:
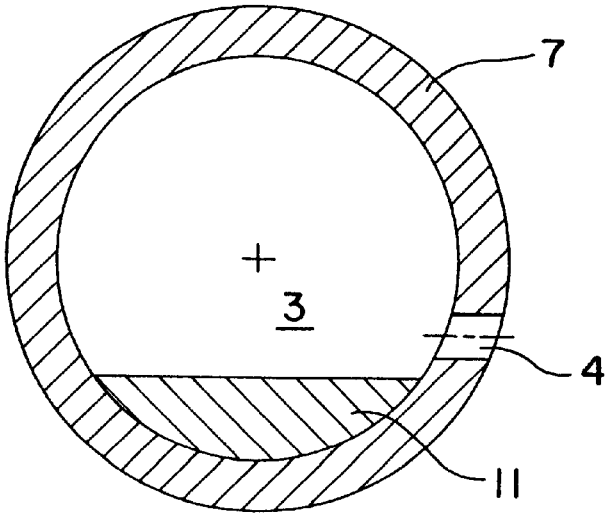

FIGS. 4 and 5 show two still further embodiments of a distributing apparatus with filler elements 11 provided within housing 7. Filler elements 11 influence the cross section of tubular manifold 3 contingent on the stressed cross-sectional area of filler element 11. With filler elements 11 configured such that they are wholly or sectionally inflatable, an individual adjustment of the cross section of tubular manifold 3 is achievable here as well.

Figure 6:
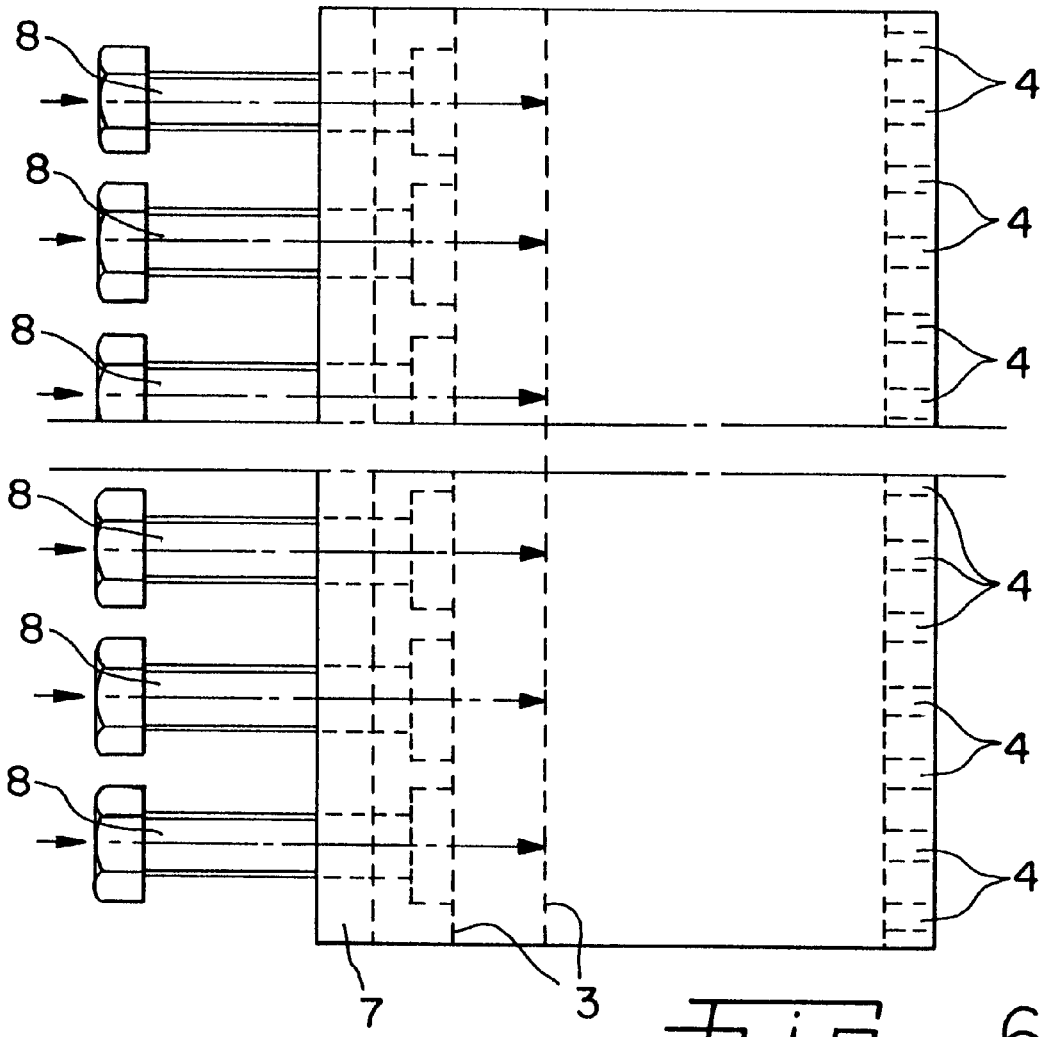
FIG. 6 is a top view of the distributing apparatus of FIG. 3.

FIG. 6 is a top view of distributing apparatus 2 of FIG. 3 wherein it can be seen that the adjustment mechanism includes a plurality of adjustment screw 8 distributed across the width of the traveling fiber material web. Adjustment screw 8 can be individually adjusted in order to sectionally vary the cross section of tubular manifold 3 across the width of the traveling fiber material web.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A distributing apparatus for one of direct and indirect application of a coating medium onto a traveling fiber material web having a width, said distributing apparatus comprising:

a tubular manifold including an inlet, an outlet and a longitudinal direction, said tubular manifold extending in said longitudinal direction substantially across the width of the fiber material web, said tubular manifold including a variable cross section when viewed generally parallel to said longitudinal direction that is adjustable substantially across the width of the fiber material web, said tubular manifold configured for allowing passage of the medium.

2. The distributing apparatus of claim 1, wherein said tubular manifold includes two opposite ends aligned in said longitudinal direction, said inlet of said manifold being disposed at one of said ends of said manifold.

3. A distributing apparatus for one of direct and indirect application of a coating medium onto a traveling fiber material web having a width, said distributing apparatus comprising:

a tubular manifold including an inlet, an outlet and a longitudinal direction said tubular manifold extending in said longitudinal direction substantially across the width of the fiber material web, said tubular manifold including a variable cross section when viewed generally parallel to said longitudinal direction, said cross section of said tubular manifold being one of sectionally variable across the width of the fiber material web and continuously variable across the width of the fiber material web, said tubular manifold configured for allowing passage of the medium.

4. The distributing apparatus of claim 3, wherein said cross section of said tubular manifold has a variable cross-sectional area and a constant circumference.

5. The distributing apparatus of claim 3, wherein said cross section of said tubular manifold has a variable cross-sectional area and a variable circumference.

6. The distributing apparatus of claim 3, wherein said cross-sectional area of said tubular manifold is configured to be variable during operation of said distributing apparatus.

7. The distributing apparatus of claim 3, further comprising at least one filler element disposed within said tubular manifold, said at least one filler element for varying said cross section of said tubular manifold.

8. The distributing apparatus of claim 7, wherein at least one said filler element is inflatable.

9. The distributing apparatus of claim 3, wherein said tubular manifold is elastically deformable for varying said cross section of said tubular manifold.

10. The distributing apparatus of claim 9, further comprising a mechanical adjustment mechanism configured for exerting pressure on said tubular manifold and thereby varying said cross section of said tubular manifold.

11. The distributing apparatus of claim 10, wherein said mechanical adjustment mechanism is one of thermal, hydraulic, pneumatic, magnetic, magnetostrictive and piezoelectric.

12. The distributing apparatus of claim 10, wherein said mechanical adjustment mechanism is configured for being remotely controlled.

13. The distributing apparatus of claim 12, wherein said mechanical adjustment mechanism is configured for being automatically remotely controlled in a closed loop based upon measured valued of the cross-sectional profile of the applied medium.

14. The distributing apparatus of claim 10, wherein the distributing apparatus has a width, and wherein said mechanical adjustment mechanism includes a plurality of adjustment screws distributed across the width of the distributing apparatus.

15. The distributing apparatus of claim 10, wherein said mechanical adjustment mechanism includes a plurality of actuators distributed across the width of the fiber material web, said actuators being respectively connected with a plurality of plungers for sectionally deforming said tubular manifold.

16. The distributing apparatus of claim 15, wherein each said actuator comprises a motor.

17. The distributing apparatus of claim 1, wherein said cross section of said tubular manifold has an adjustable cross-sectional area and a constant circumference.

18. The distributing apparatus of claim 1, further comprising at least one filler element disposed within said tubular manifold, said at least one filler element for adjusting said cross-sectional area of said tubular manifold.

19. The distributing apparatus of claim 1, wherein said tubular manifold is elastically deformable for adjusting said cross-sectional area of said tubular manifold.

* * * * *

UNITED STATES PATENT AND TRADEMARK OFFICE

CERTIFICATE OF CORRECTION

PATENT NO. : 6,010,078

DATED : January 4, 2000

INVENTOR(S) : Bernd Eberhardt, et al.

It is certified that error appears in the above-identified patent and that said Letters Patent is hereby corrected as shown below:

TITLE PAGE

Section [73], delete "Del." and substitute --DE-- therefor.

Signed and Sealed this

Twenty-third Day of January, 2001

*Attest:*

*Attesting Officer*

Q. TODD DICKINSON

*Commissioner of Patents and Trademarks*